US009815119B2

(12) United States Patent
Karakkunnummal et al.

(10) Patent No.: US 9,815,119 B2
(45) Date of Patent: Nov. 14, 2017

(54) METHOD FOR PRODUCING A WEAR-RESISTANT ROLLER COMPONENT

(71) Applicant: FLSmidth A/S, Valby (DK)

(72) Inventors: Biju Karakkunnummal, Calicut (IN); David Dam Olsson, Skødstrup (DK); Raghunathan Swaminathan, Chennai (IN); Ulf Waag, Bad Säckingen (DE)

(73) Assignee: FLSmidth A/S (DK)

( * ) Notice: Subject to any disclaimer, the term of this patent is extended or adjusted under 35 U.S.C. 154(b) by 388 days.

(21) Appl. No.: 14/415,792

(22) PCT Filed: Jul. 9, 2013

(86) PCT No.: PCT/DK2013/050233
§ 371 (c)(1),
(2) Date: Jan. 20, 2015

(87) PCT Pub. No.: WO2014/019588
PCT Pub. Date: Feb. 6, 2014

(65) Prior Publication Data

US 2015/0231700 A1 Aug. 20, 2015

(30) Foreign Application Priority Data

Jul. 31, 2012 (DK) ..... 2012 70458

(51) Int. Cl.
*B02C 4/00* (2006.01)
*B22F 7/08* (2006.01)
(Continued)

(52) U.S. Cl.
CPC ..... *B22F 7/08* (2013.01); *B02C 4/30* (2013.01); *B02C 4/305* (2013.01); *B22F 3/15* (2013.01); *B22F 5/00* (2013.01); *B22F 7/062* (2013.01)

(58) Field of Classification Search
CPC .... B22F 7/08; B22F 7/062; B22F 5/00; B22F 3/15; B02C 4/305
(Continued)

(56) References Cited

U.S. PATENT DOCUMENTS 6,086,003 A 7/2000 Guenter et al.

FOREIGN PATENT DOCUMENTS

| | | | |
|---|---|---|---|
| CN | 102211196 | A | 10/2011 |
| WO | 2010150225 | A | 12/2010 |
| WO | 2013060330 | A2 | 5/2013 |

OTHER PUBLICATIONS

Köppern, Hexadur Wear Protection for the Cement Industry, Mar. 1, 2012, 12-13Köppern, http://www.koeppern-international.com/uploads/media/Hexadur_01.pdf.

(Continued)

*Primary Examiner* — Faye Francis
(74) *Attorney, Agent, or Firm* — Matthew R. Weaver

(57) ABSTRACT

Described is a wear-resistant roller component for handling abrasive materials where the component comprises a metal body with at least one surface. It is characterized in that a metal template having a pattern of through-going holes is arranged on the at least one surface of the metal body and in that a cover arranged to cover at least a part of the metal template is located at a distance from the metal template to form a gap between the cover and the metal template and in that a powder material suitable for sintering is introduced into the through-going holes in the metal template through the gap and in that the metal body, the metal template, the cover and the material powder are bonded together by means of a sintering process.

7 Claims, 3 Drawing Sheets

(51) Int. Cl.

| | |
|---|---|
| ***B22F 7/06*** | (2006.01) |
| ***B22F 3/15*** | (2006.01) |
| ***B22F 5/00*** | (2006.01) |
| ***B02C 4/30*** | (2006.01) |

(58) Field of Classification Search
USPC ..... 241/293
See application file for complete search history.

(56) References Cited

OTHER PUBLICATIONS

International Search Report and Written Opinion dated Nov. 22, 2013, 10 pages.

METHOD FOR PRODUCING A WEAR-RESISTANT ROLLER COMPONENT

The present invention relates to a method for producing a wear-resistant roller component where at least one surface of a metal body is provided with a wear-resistant layer. According to the method, a powder metallurgical steel is applied to the component to obtain a wear-resistant surface when subjected to a sintering process. The component may have a plane or curved surface and may be used in all kinds of applications where surfaces need to be protected when handling abrasive materials. The method may for example be used for various types of tools exposed to extensive wear, in conveying arrangements for transporting abrasive materials, or in equipment for crushing materials. The invention also relates to a wear-resistant roller component produced by the method according to the invention.

In recent years particularly rollers for crushing abrasive materials have attracted great interest since the known rollers either lack in performance, durability and/or are very expensive to manufacture. Rollers of this kind are well-known in the patent literature, for example from U.S. Pat. No. 6,086,003 which describes how a wear-resistant layer consisting of two different powder metallurgical steels is applied to a surface of a roller for a roller press by means of a sintering process. The advantage of using powder metallurgical steels is that a surface with a very high content of hard phases and a high toughness can be achieved due to a fine microstructure and small well-distributed carbides. The powder metallurgical technology furthermore allows for a composition of hard phases which is difficult or impossible to achieve by other techniques. Hexagonal tiles are preformed using a first material and placed on the surface of a roller covering the largest area of the surface and a second material is placed between the tiles. Whereas the first material has a very high content of carbides and thus a high wear resistance, the second material has a lower content of carbides and therefore a higher wear rate but also a higher toughness, i.e. high resistance to crack propagation. This difference in wear and mechanical properties of the two materials will ensure that an autogenous wear protection is obtained and that fractures in the surface due to tramp metal etc. are avoided. The sintering process used is Hot Isostatic Pressing (HIP) where the metallurgical powder is consolidated to 100 percent density by applying a pressure above 1000 bar and a temperature above 1000° C. Given that each tile in U.S. Pat. No. 6,086,003 is produced by means of a separate sintering and compaction process and due to the fact that each tile must be placed one by one on the surface of the roller with a relatively high degree of precision and since the entire circumference of the roller must be covered with tiles before the final sintering it is a very time-consuming process to manufacture such a roller. As a consequence hereof, the manufacture of such rollers involves significant costs.

It is an object of the present invention to provide a wear-resistant roller component by means of which the manufacturing costs are significantly reduced.

This is obtained by a method of the kind mentioned in the introduction, and being characterized in that the method comprises the steps of:

arranging a metal template having a pattern of through-going holes on at least one surface of the metal body;

providing a cover covering at least a part of the metal template and arranging the cover at a distance to the metal template to form a gap between the cover and the metal template;

applying a powder material suitable for being sintered into the through-going holes of the metal template by introducing the powder material into the gap between the cover and the metal template; and bonding together the metal body, the metal template, the cover and the powder material in a sintering process, such that the wear resistance of the metal template is lower than the wear resistance of the metal powder after the sintering process.

Hereby it is obtained that it will be possible to cover a metal body with a wear-resistant layer in a fast, inexpensive and simple way. Furthermore, in cases involving wear-resistant rollers, it will be possible to manufacture such rollers in a single process step with regard to sintering thereby considerably reducing the time needed for manufacturing and therefore reducing also the costs for such rollers.

It is preferred that the wear resistance of the metal template is significantly lower than the wear resistance of the sintered powder material. In this way the metal template can be made from a material with low resistance against wear and not by use of the expensive and time-consuming powder technology. Hereby it is obtained that the metal template will be easy and inexpensive to manufacture. It is preferred that the metal template is made from carbon steel, such as mild or low carbon steel.

It is preferred that the cover at least covers the main part of the surface of the metal template which at least covers the main part of the metal body in order to ensure that the surface is protected to sufficient extent.

The distances between the metal body and the cover should at least be 3 millimeters for leaving enough space for introduction of the powder material in the space between these parts.

The size of the through-going holes and the distance between the holes will depend on the type and size of the material to be handled in order to ensure formation of a necessary autogenous layer which reduces the wear on the wear-resistant roller component. During operation of the component the metal template will be worn a lot faster than the surrounding sintered powder material, since the metal template is made from plain carbon steel, preferably mild steel, which have very low wear resistance to the abrasive materials being handled during operation. The areas appearing around the sintered powder material when the metal template is worn will be filled with the abrasive materials which will wear against themselves in these areas.

In principle the through-going holes may have any conceivable shapes as long as wear protection is established when the metal template is worn. For example the holes may be circular, square-shaped or polygonal configured and positioned with the same distance or with a varying distance to each other. The holes may be provided by means of laser cutting which is a quick and precise method. Stamping of the holes is also an option, especially in case of high volume production. It is preferred that the holes cover at least 60 percent of the surface area of the metal template in order to ensure an advantageous wear protection.

It is preferred that the sintering is carried out by means of a Hot Isostatic Pressing (HIP) process since this process ensures an excellent wear resistance for the powder material and also a strong bond between the metal body, the metal template, the cover and the powder material. A buffer layer between the metal body and the metal template may be used to obtain an even stronger bond and/or to obtain a greater variety of alloys which can be used for the metal body and the metal template, respectively.

The powder material to be sintered is a powder metallurgical steel which may be blended with refractory particles such as carbides, nitrides, oxides, borides or silicides to obtain a very high resistance against wear.

In the following the invention particularly will be described with respect to wear-resistant rollers for use in roller presses, roller mills or similar equipment. In such machinery typically particulate material such as crude ore, cement raw material or cement clinker is processed.

The invention will now be explained in greater detail with reference to the drawing, being diagrammatical, and where FIG. 1 shows a three-dimensional view of a wear-resistant roller according to the invention.

Figure 1:
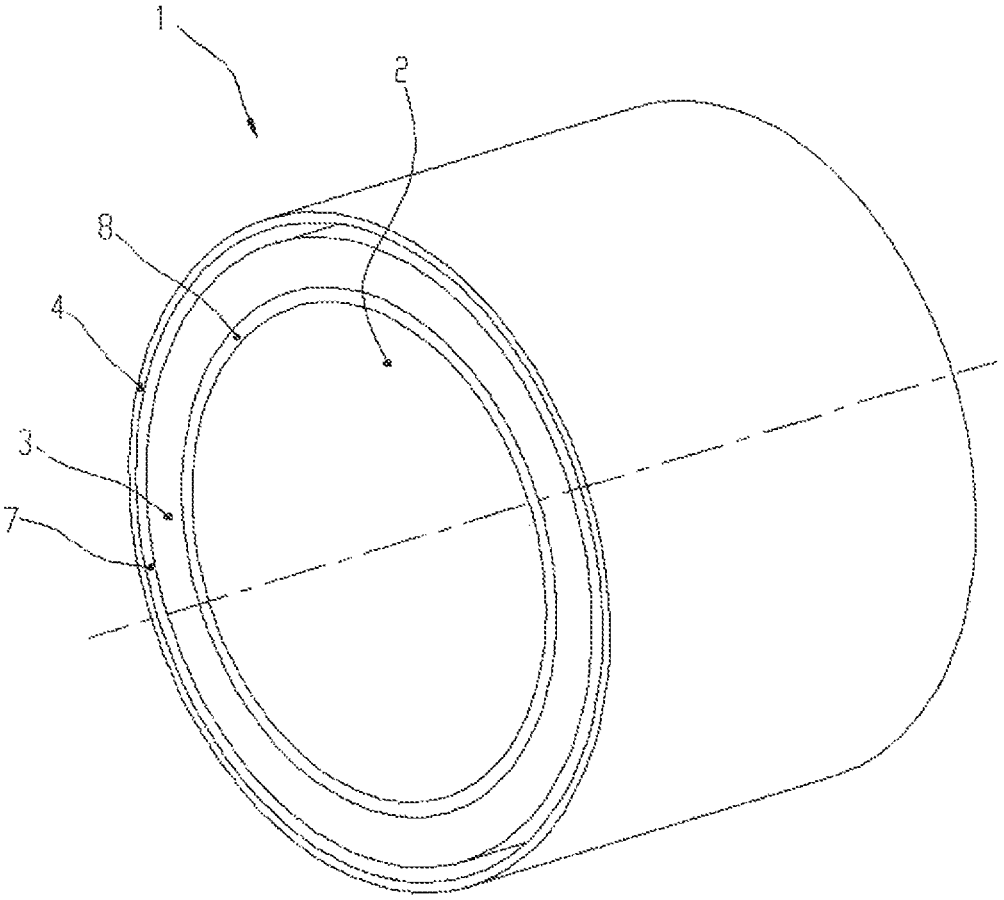
Figure 2:
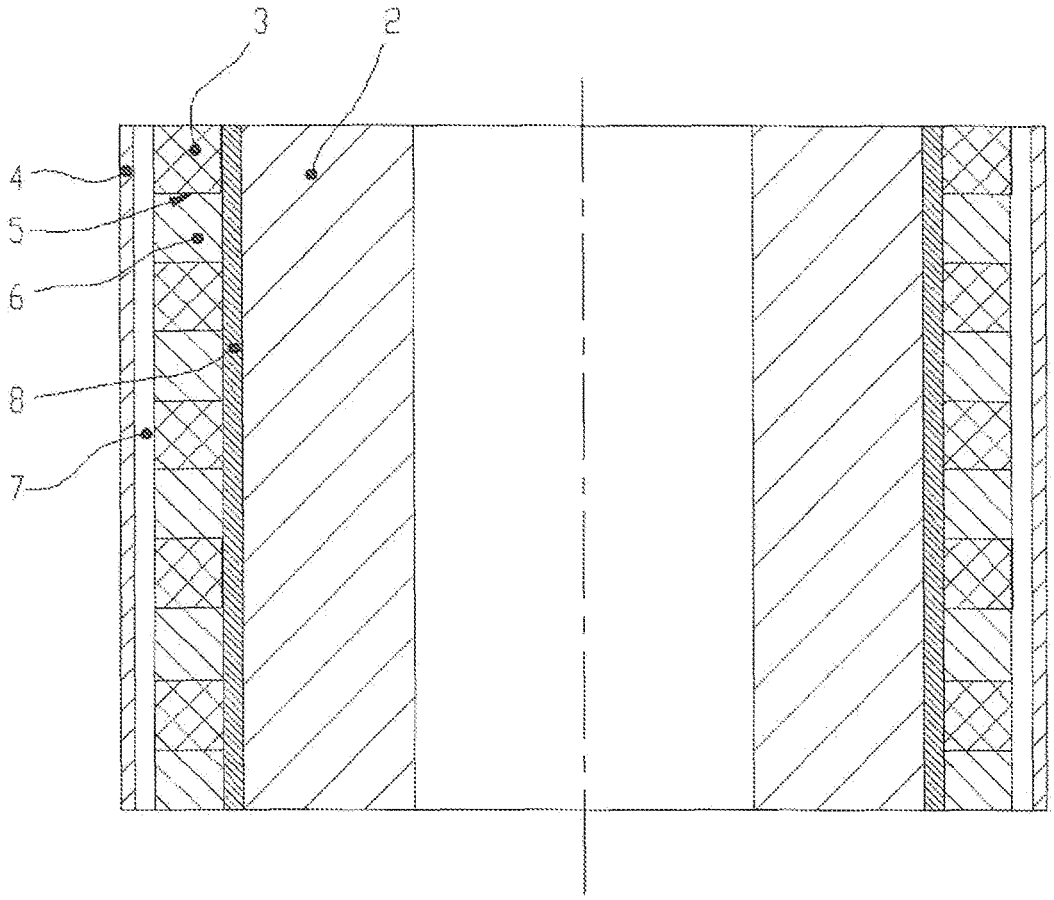
FIG. 2 shows a cross-sectional view of the roller shown in FIG. 1.

FIG. 1 shows a three-dimensional view of a wear-resistant roller 1 produced by the method according to the invention. A tube-shaped metal template 3 and a tube-shaped metal cover 4 are arranged concentrically around a cylindrically metal body 2. This metal body 2 may be tube-shaped as shown in FIG. 2. The outer diameter of the tube-shaped metal template 3 is smaller than the inner diameter of the tube-shaped cover 4 to form a gap 7 between these two parts. The radial extent of the gap 7 must be large enough to allow powder material 6 to flow along the axial direction of the cylindrically metal body 2 when the powder material 6 is introduced into the gap 7. A buffer layer 8 arranged between the metal body 2 and the metal template 3 is optional but may be used to enhance the bond between the parts.

FIG. 2 shows a cross-sectional view through a vertical plane comprising the centreline of the roller shown in FIG. 1. The metal template 3 is made from a steel sheet into which a pattern of holes 5 is cut after which it is either hot or cold rolled (depending of the steel sheet thickness) to form a tube-shaped metal template 3. The powder material 6 is a powder metallurgical steel which is introduced into the gap 7 between the metal template 3 and the cover 4 to fill the holes 5 in the metal template 3. Both the holes 5 and the gap 7 will be filled with the powder material 6. End stops (not shown) at each end of the gap 7 will ensure that the powder material 6 is kept in place prior to and during the sintering process. After the holes 5 have been filled with the powder material 6, the entire assembly undergoes air evacuation and then the assembly is subjected to a sintering process, preferably a hot isostatic pressing process (HIP), where the metal body 2, the metal template 3, the cover 4 and the powder material 6 are bonded together.

During operation of the wear-resistant roller 1 the cover 4 will be worn off rather quickly as it is made from a material with very low resistance against wear. Furthermore, the metal template 3 is made from a material which has a significantly lower resistance against wear compared to the sintered powder material 6 which means that grooves around the sintered powder material 6 will be formed. These grooves will be effectively filled with fine particles of the crushed material. The fine particles are compacted in the grooves entailing an effective retention on the surface. Thereby an autogenous wear protection is established as the crushed material wears against the fine particles in the grooves. As the build-up of the autogenous layer is enhanced by a favourable layout of the sintered powder material it is of great importance that the holes 5 in the metal template 3 are arranged in an advantageous way. The autogenous effect reduces further wear of the roller and also contributes to an increased throughput due to increased friction between the materials to be processed and the materials in the grooves. Thus an optimal texture of the surface of the wear-resistant roller 1 would have significant advantages for the operation given its importance for reducing wear and for increasing the production.

Figure 3:
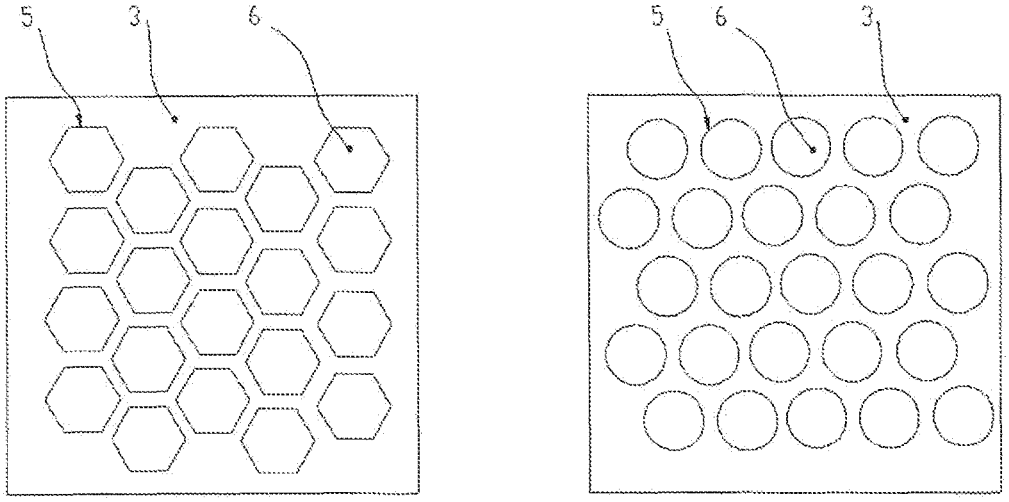
FIG. 3 shows two different embodiments of a layout for a wear-resistant layer according to the invention.

FIG. 3 shows two different embodiments of a layout for a wear-resistant layer. The holes 5 in the two shown sections of different types of metal templates 3 are circular and polygonal-shaped, respectively, but may have other shapes. The shape of the holes 5, which forms the highly wear-resistant zones of sintered powder material 6, and the distance between the holes 5 will depend on the type and size of the material to be processed in order to ensure formation of the necessary autogenous layer which reduces the wear on the wear-resistant roller. Usually the holes 5 cover more than 60 percent of the surface area of the metal template 3.

The invention claimed is:

1. A method for producing a wear-resistant roller component comprising the steps of:

arranging a metal template having a pattern of through-going holes on at least one surface of a metal body;

providing a cover covering at least a part of the metal template and arranging the cover at a distance to the metal template to form a gap between the cover and the metal template;

applying a powder material suitable for being sintered into the through-going holes of the metal template by introducing the powder material into the gap between the cover and the metal template; and bonding together the metal body, the metal template, the cover and the powder material in a sintering process, such that the wear resistance of the metal template is lower than the wear resistance of the metal powder after the sintering process.

2. The method of claim 1 wherein the metal template is made from low-carbon steel.

3. The method of claim 1 wherein the sintering process is a hot isostatic pressing process.

4. A wear-resistant roller component for handling abrasive materials comprising a metal body with at least one surface wherein a metal template having a pattern of through-going holes is arranged on the at least one surface of the metal body and in that a cover arranged to cover at least a part of the metal template is arranged at a distance from the metal template to form a gap between the cover and the metal template and in that a powder material suitable for sintering is introduced into the through-going holes in the metal template through the gap and in that the metal body, the metal template, the cover and the material powder are bonded together by means of a sintering process.

5. The wear-resistant roller component according to claim 4 wherein the distance between the metal template and the metal body is at least 3 millimeters.

6. The wear-resistant roller component according to claim 4 wherein the through-going holes cover at least 60 percent of the surface area of the metal template.

7. The wear-resistant roller component according to claim 4 wherein the metal body is a cylindrical roller body.

* * * * *